US008112964B2

(12) United States Patent
Baruh

(10) Patent No.: US 8,112,964 B2
(45) Date of Patent: Feb. 14, 2012

(54) CLIP FOR JOINING REINFORCED MEMBERS FOR USE IN REINFORCED CONCRETE SLABS AND/OR COLUMNS

(76) Inventor: Bradford G. Baruh, Hillsborough, CA (US)

( * ) Notice: Subject to any disclaimer, the term of this patent is extended or adjusted under 35 U.S.C. 154(b) by 0 days.

(21) Appl. No.: 13/027,585

(22) Filed: Feb. 15, 2011

(65) Prior Publication Data

US 2011/0162317 A1 Jul. 7, 2011

Related U.S. Application Data

(63) Continuation-in-part of application No. 11/967,769, filed on Dec. 31, 2007, now Pat. No. 7,886,498.

(51) Int. Cl.
*E04C 5/16* (2006.01)

(52) U.S. Cl. ..... 52/719; 52/712; 52/686; 52/685

(58) Field of Classification Search ..... 52/712, 52/713, 685, 686, 719, 665; 24/328, 337, 24/339, 457, 26–29; 403/207, 374.5; 256/57; 245/3; 248/302; 140/82
See application file for complete search history.

(56) References Cited

U.S. PATENT DOCUMENTS

| | | | | |
|---|---|---|---|---|
| 119,024 | A * | 9/1871 | Franklin | 248/217.2 |
| 261,618 | A | 7/1882 | Lufkin | |
| 266,704 | A | 10/1882 | Lufkin | |
| 345,516 | A | 7/1886 | Logan | |
| 348,471 | A | 8/1886 | Mahon | |
| 445,876 | A | 2/1891 | Brown | |
| 549,964 | A | 11/1895 | Hollinger | |
| 616,607 | A * | 12/1898 | Dorion | 248/328 |
| 655,882 | A | 8/1900 | Maxwell | |
| 776,810 | A * | 12/1904 | Smalley | 248/218.2 |
| 777,183 | A | 12/1904 | Clausing | |
| 919,099 | A | 4/1909 | Wedmore | |
| 959,217 | A | 5/1910 | Hallahan | |
| 996,211 | A * | 6/1911 | Carswell | 256/55 |
| 1,048,280 | A * | 12/1912 | Bennett | 224/248 |
| 1,099,679 | A * | 6/1914 | Wedmore | 52/685 |
| 1,119,123 | A | 12/1914 | Schoenthaler | |
| 1,124,536 | A | 1/1915 | Schoenthaler | |
| 1,126,493 | A | 1/1915 | Lampert | |
| 1,136,011 | A | 4/1915 | Hulstedy | |
| 1,143,323 | A | 6/1915 | Schoenthaler | |
| 1,149,648 | A | 8/1915 | Henderson | |
| 1,213,919 | A | 5/1916 | Symons | |
| 1,185,764 | A | 6/1916 | Brooks | |

(Continued)

FOREIGN PATENT DOCUMENTS

GB 2037862 A * 7/1980

*Primary Examiner* — Robert Canfield
*Assistant Examiner* — Charissa Ahmad
(74) *Attorney, Agent, or Firm* — Buchanan Ingersoll & Rooney PC

(57) ABSTRACT

A clip for joining reinforcing members, which includes a first pair of legs, each of the legs of the first pair of legs having a portion having a curvature thereto and adapted to wrap around a lower surface of a first reinforcing member; a second pair of legs, each of the legs of the second pair of legs having an inner surface adapted to exert a force against at least a portion of a side surface of a second reinforcing member, and a mid-portion, which connects the first pair of legs to the second pair of legs.

6 Claims, 8 Drawing Sheets

U.S. PATENT DOCUMENTS 1,189,297 A 7/1916 Schoenthaler
1,236,254 A * 8/1917 Bloomberg ..... 248/212
1,306,129 A * 6/1919 Stewart ..... 52/686
1,372,077 A 3/1921 Hays
1,467,741 A * 9/1923 Tubbs ..... 52/719
1,500,832 A 7/1924 Gifford
1,621,478 A 3/1927 White
1,637,742 A 8/1927 Edge et al.
1,737,396 A 11/1929 White
1,768,269 A 6/1930 Prescott
1,807,898 A 6/1931 Davidson
1,816,833 A 8/1931 Ehlers
1,838,124 A 12/1931 White
1,890,757 A 12/1932 Strickler
1,912,704 A 6/1933 Graham
2,102,566 A 12/1937 Brickman et al.
2,212,212 A 8/1940 Planitz
2,298,104 A 10/1942 Brunemann
2,349,399 A 5/1944 Powell
2,407,249 A 9/1946 Burner et al.
2,420,860 A 5/1947 Burner
2,503,859 A * 4/1950 Webber ..... 248/302
2,505,273 A 4/1950 Bolduc
2,816,338 A 12/1957 Klancnik, Jr.
2,849,770 A 9/1958 Klancnik, Jr.
2,942,314 A 6/1960 Debner
3,102,614 A 9/1963 Lydard
3,130,821 A 4/1964 Dunlap
3,166,819 A * 1/1965 Robbins ..... 27/21.1
3,277,626 A 10/1966 Wilfred et al.
3,359,019 A 12/1967 Pinkney
3,393,006 A 7/1968 Werner et al.
3,621,538 A 11/1971 Nickason
3,922,103 A 11/1975 Hirato
4,132,045 A 1/1979 Sullivan
4,217,021 A 8/1980 Illum
4,388,791 A 6/1983 Anderson
4,640,063 A 2/1987 Ayala
4,641,991 A 2/1987 Yaoita
4,759,177 A 7/1988 Brazell
4,939,883 A 7/1990 Swenson
5,011,055 A 4/1991 Neugent
5,634,310 A 6/1997 Hohmann
D398,836 S 9/1998 Kalat
5,878,546 A * 3/1999 Westover ..... 52/719
5,896,722 A 4/1999 Swenson
6,128,882 A 10/2000 Jones
6,279,283 B1 8/2001 Hohmann et al.
6,499,514 B1 12/2002 Hodge, Sr.
7,377,083 B2 5/2008 McCafferty et al.
7,413,153 B1 8/2008 Ghormley
7,503,719 B1 3/2009 Ruel et al.
7,506,482 B2 * 3/2009 Sorkin ..... 52/685
2007/0157541 A1 7/2007 Mossbeck et al.
2009/0188200 A1 * 7/2009 Kelly ..... 52/719
2010/0018011 A1 1/2010 Borque

* cited by examiner

CLIP FOR JOINING REINFORCED MEMBERS FOR USE IN REINFORCED CONCRETE SLABS AND/OR COLUMNS

CROSS REFERENCE TO RELATED APPLICATION

This application is a Continuation-in-part of U.S. patent application Ser. No. 11/967,769, filed Dec. 31, 2007, now U.S. Pat. No. 7,886,498, which is incorporated herein in their entirety.

FIELD OF THE INVENTION

This invention generally relates to a system and method of joining reinforcing members for use in concrete slabs and/or columns, and more particularly, a clip for joining reinforcing members for use in reinforced concrete slabs and/or columns.

BACKGROUND

In the manufacture of reinforced concrete structures, such as concrete pipes or columns, walls, slabs, and the like, it is important that the steel reinforcement, typically in the form of welded-wire mesh, be properly positioned in the cross section of the designed structure. Improper positioning of the reinforcement degrades the structural integrity of the unit and, in a severe case, can lead to structural failure. Moreover, as labor skill and costs are significant factors in the manufacture of reinforced concrete structures, it is also important that the positioning of the reinforcement be carried out in an accurate, and as simple and straightforward manner as possible. Heretofore it has been the practice of manually wrapping a tie wire around the intersecting steel reinforcing members (i.e., rebar) in walls, mats, piers, tie beams, slabs, etc.

SUMMARY

In accordance with one embodiment, a clip for joining reinforcing members comprises: a first wire member having an upper mid-portion and pair of legs, each of the legs having a hook portion adapted to wrap around a lower surface of a first reinforcing member; and a second wire member having a lower mid-portion and a handle portion, the lower mid-portion sized to seat on an upper surface of a second reinforcing member.

In accordance with another embodiment, a system for joining reinforcing members comprises: a first reinforcing member; a second reinforcing member, which resides perpendicular to the first reinforcing member; and a clip comprising: a first wire member having an upper mid-portion and pair of parallel legs, each of the parallel legs having a hook portion adapted to wrap around a lower surface of the first reinforcing member; and a second wire member having a lower mid-portion sized to seat on an upper surface of the second reinforcing member, each end of the lower mid-portion extending outward and wrapping around an outer portion of the upper mid-portion of the first wire member at least once and extending parallel to the second reinforcing member to form a handle portion.

In accordance with a further embodiment, a method of joining reinforcing members comprises: positioning a first reinforcing member perpendicular to a second reinforcing member; and attaching the first reinforcing member to the second reinforcing member with a clip, the clip comprising: a first wire member comprising an upper mid-portion and pair of parallel legs, each of the parallel legs having a hook portion adapted to wrap around a lower surface of the first reinforcing member; and a second wire member having a lower mid-portion sized to seat on an upper surface of the second reinforcing member, each end of the lower mid-portion extending outward and wrapping around an outer portion of the upper mid-portion of the first wire member at least once and extending parallel to the second reinforcing member to form a handle portion.

In accordance with another embodiment, a clip for joining reinforcing members comprises: a first pair of legs, each of the legs of the first pair of legs having a portion having a curvature thereto and adapted to wrap around a lower surface of a first reinforcing member; a second pair of legs, each of the legs of the second pair of legs having an inner surface adapted to exert a force against at least a portion of a side surface of a second reinforcing member, and a mid-portion, which connects the first pair of legs to the second pair of legs.

In accordance with a further embodiment, a system for joining reinforcing members comprises: a first reinforcing member; a second reinforcing member, which resides perpendicular to the first reinforcing member; and a clip comprising a first pair of legs, each of the legs of the first pair of legs having a portion having a curvature thereto and adapted to wrap around a lower surface of a first reinforcing member; a second pair of legs, each of the legs of the second pair of legs having an inner surface adapted to exert a force against at least a portion of a side surface of a second reinforcing member, and a mid-portion, which connects the first pair of legs to the second pair of legs.

In accordance with another embodiment, a method of joining reinforcing members comprises: positioning a first reinforcing member perpendicular to a second reinforcing member; and attaching the first reinforcing member to the second reinforcing member with a clip, the clip comprising: a first pair of legs, each of the legs of the first pair of legs having a portion having a curvature thereto and adapted to wrap around a lower surface of a first reinforcing member; a second pair of legs, each of the legs of the second pair of legs having an inner surface adapted to exert a force against at least a portion of a side surface of a second reinforcing member, and a mid-portion, which connects the first pair of legs to the second pair of legs.

BRIEF DESCRIPTION OF THE DRAWINGS

In the following, exemplary embodiments will be explained in greater detail in reference to drawings, wherein.

DETAILED DESCRIPTION

Figure 1:
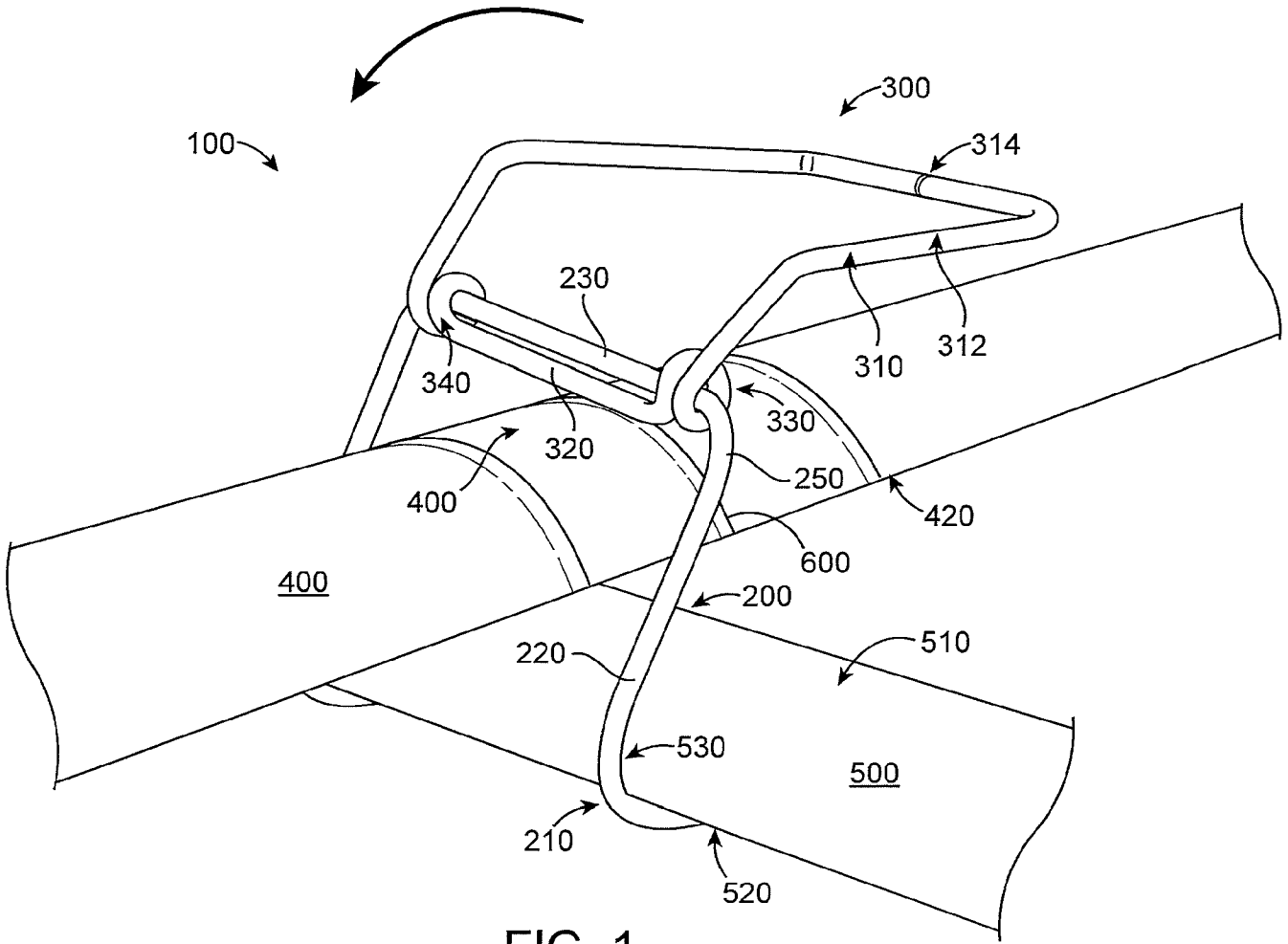
FIG. 1 is a perspective view of a clip for joining reinforcing members for use in reinforced concrete slabs and/or columns in accordance with one embodiment.

In accordance with an embodiment, a clip 100 for joining reinforcing members 400, 500 for use in reinforced concrete slabs and/or columns is shown in FIG. 1. As shown in FIG. 1, the clip 100 is comprised of a first wire member 200 and a second wire member 300, which join or attach a pair of structural members 400, 500 together. The first wire member 200 includes an upper mid-portion 230 and pair of legs 220, which are preferably parallel to one another. Each of the legs 220 has a hook portion 210, which is adapted to wrap around a lower surface 520 of a first reinforcing member 500. The hook portion 210 of the first wire member 200 includes a pair of first ends 240 (FIG. 2), which preferably extend around the lower surface 520 of the first reinforcing member 500. In accordance with an embodiment, the ends 240 of the first wire member 200 extends slightly upward towards an upper surface 510 of the first reinforcing member 500 along a side edge or surface 530 of the first reinforcing member 500.

The second wire member 300 has a lower mid-portion 320 sized to seat on an upper surface 410 of a second reinforcing member 400, which resides perpendicular to the first reinforcing member 500. Each end 330 of the lower mid-portion 320 extends outward, wraps around an outer portion 250 of the upper mid-portion 230 of the first wire member 200 at least once, and extends parallel to the second reinforcing member 400 to form a handle portion 310.

It can be appreciated that the handle portion 310 can be rectangular, oval or any other suitable shape. For example, in accordance with an embodiment, the handle portion 310 is comprised of a pair of parallel handle members 312, which extend parallel to the second reinforcing member 400. In accordance with an embodiment, the pair of parallel handle members 312 each has an end 314, which are preferably welded together so that the handle portion 310 has a smooth feel without abrasive edges and/or corners. However, it can be appreciated that for ease of manufacturing, in an alternative embodiment, the ends 314 of the second wire member 300 are not welded together, and are bent or formed into the handle portion 310.

The clip 100 (i.e., the first and the second wire members 200, 300) is preferably made of a stiff resiliently yielding material, such as spring steel. In accordance with an embodiment, the clip 100 (i.e., the first and second wire members 200, 300) can be made from a high-carbon spring steel, an alloy spring steel, a stainless spring steel, a copper-base spring alloy, and/or a nickel-base spring alloy.

The first and second reinforcing members 400, 500 can be a wire mesh, steel reinforcing rods or members (i.e., steel rebar) or any other suitable material, which is used for reinforced concrete and reinforced masonry structures, including concrete slabs and/or columns. In accordance with an embodiment, the first and second reinforcing members 400, 500 are steel reinforcing members (i.e., rebar) formed from carbon steel with a plurality ridges (or grooves) 600, which extend around the outer circumference of the reinforcing members 400, 500, and also extending longitudinally or lengthwise. In accordance with an embodiment, the ridges (or grooves) 600 can be a plurality of circular rings or other suitable circular pattern or shape. Alternatively, it can be appreciated that other non-circular patterns can be used. It can be appreciated that in reinforced concrete slabs and/or columns, the ridges (or grooves) 600 provide frictional adhesion for the concrete. In addition, the first and second reinforcing members 400, 500 preferably have a coefficient of expansion, which is approximately equal to that of the concrete to provide for a stable slab and/or column.

Figure 2:
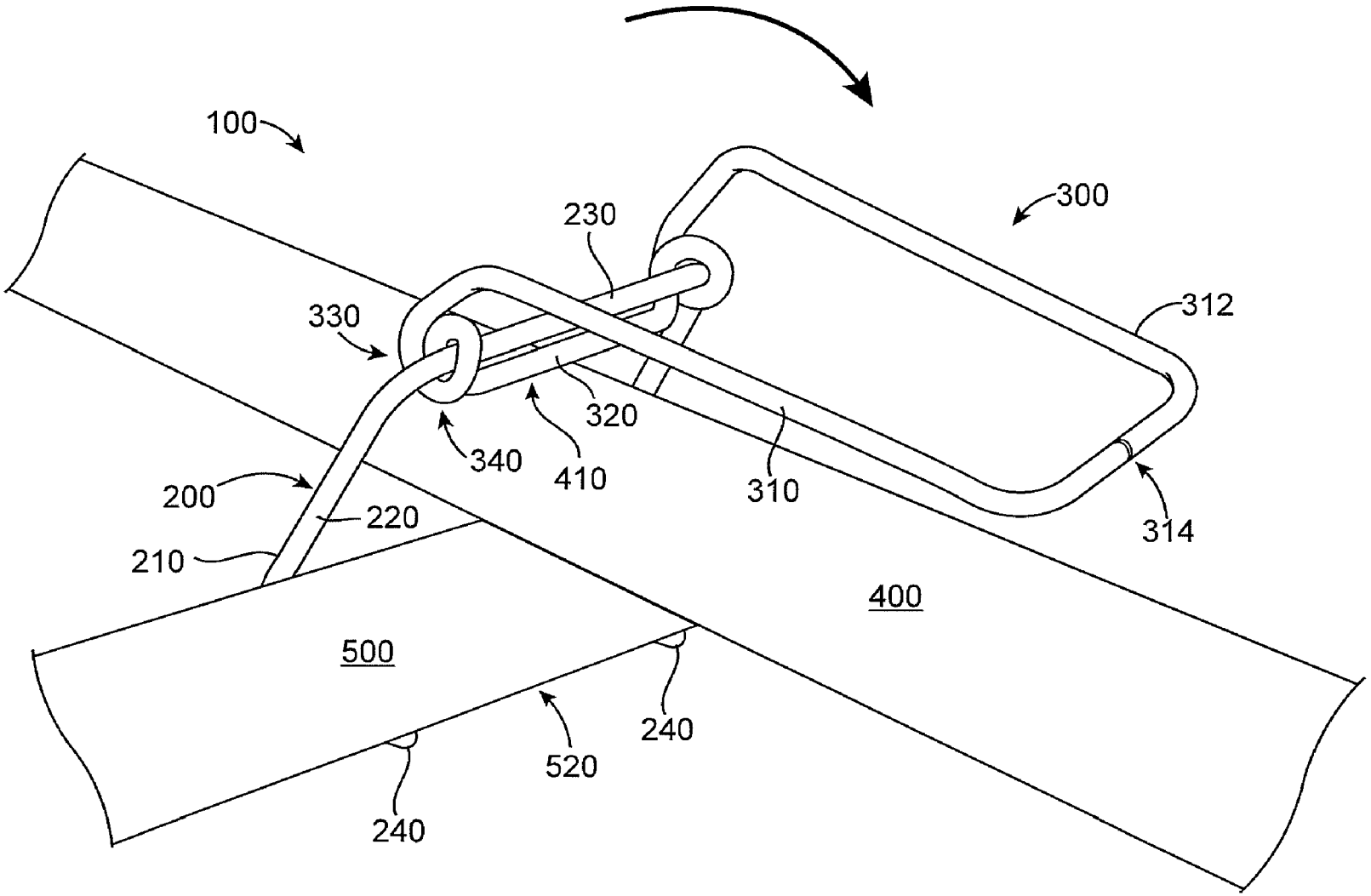
FIG. 2 is another perspective view of a clip for joining reinforcing members for use in reinforced concrete slabs and/or columns in accordance with another embodiment.

FIG. 2 is another perspective view of a clip 100 for joining reinforcing members 400, 500 for use in reinforced concrete slabs and/or columns in accordance with an embodiment. As shown in FIG. 2, the hook portions 210 of the first wire member 200 extend from the mid-portion 230 outward and then extend downward. The hook portions 210 of the first wire member 200 are preferably dimensioned (i.e., length thereof) to extend around the lower surface 520 of the first reinforcing member 500, and optionally, the hook portions 210 of the first wire member 200 can have a slight upward curve on the end thereof, such that a portion of the hook portions 210 extend along a side edge 530 of the first reinforcing member 400.

During use, upon movement of the handle portion 310 from an open position (i.e., first position) to a closed position (i.e., second position), the lower mid-portion 320 of the second wire member 300 imparts a downward load (or pressure) on the second reinforcing member 400, which translates into an upward lift or pressure on the displacement of the hook portions 210 about the lower surface 520 and the side edge 530 of the first reinforcing member 500. In accordance with an embodiment, the lower mid-portion 320 of the second wire member 300 imparts the downward load on the second reinforcing member 400 by movement of the handle portion 310 of the clip 100 to the same side of the first reinforcing member 500 as the hook portion 210 (i.e., as shown in FIG. 1 and by movement of the handle portion 310 in the direction of the arrow in FIG. 1). Alternatively, in accordance with another embodiment, the clip 100 can impart a downward load (or pressure) on the second reinforcing member 400 by movement of the handle portion 310 to the opposite side of the first reinforcing member 500 as the hook portion 210 (i.e., as shown in FIG. 2 and by movement of the handle portion in the direction of the arrow in FIG. 2). Accordingly, it can be appreciated that by adjusting the relative positions of the upper mid-portion 230, the hook portion 210, the lower mid-portion 320 and the handle portion 310 to one another, the clip 100 can be designed such that the handle portion 310 of the clip 100 can be in a closed position by the positioning the handle portion 310 on either the same or the opposite side of the first reinforcing member 500 as the hook portion 210.

Figure 3:
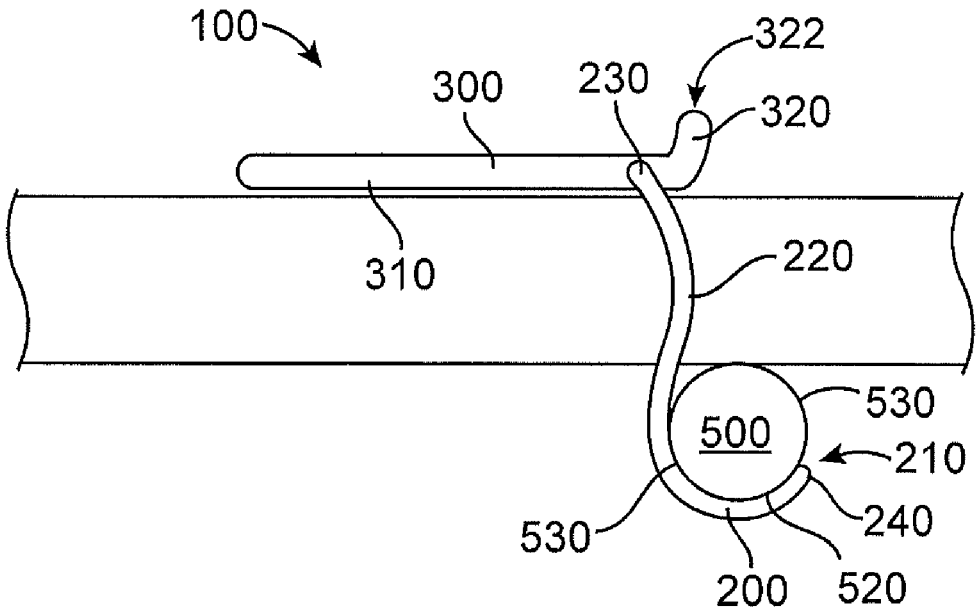
FIG. 3 is a side view of a clip for joining reinforcing members for use in reinforced concrete slabs and/or columns in accordance with another embodiment.

FIG. 3 shows a side view of a clip 100 for joining reinforcing members 400, 500 in an open position (i.e., a first position) in accordance with an embodiment. As shown in FIG. 3, the clip 100 includes a first wire member 200, which includes a pair of parallel legs 220, which are configured to wrap around a lower surface 520 of a first reinforcing member 500.

The first wire member 200 also includes an upper mid-portion 230. The second wire member 300 includes a lower mid-portion 320, which extends outward and wraps around at least once an outer portion 250 of the upper mid-portion 230 of the first wire member 200. The second wire member 300 also includes a handle portion 310. During use, the handle portion 310 is preferably configured to be grasped by an installer or user and moved from a first position, wherein the lower mid-portion 320 of the second wire member 300 is seated on an upper surface 410 of the second reinforcing member 400 and a second position, wherein the handle portion 310 moves from the first position to the second position, wherein the lower mid-portion 320 of the second wire member 300 asserts a downward pressure or load on the upper surface 410 of the second reinforcing member 400 and wherein the hook portions 210 of the first wire member 200 asserts an upward pressure or load on the lower surface 520 of the first reinforcing member 500, which results in the first and second reinforcing members 400, 500 be held in a fixed position, which is preferably perpendicular to one another.

Figure 4:
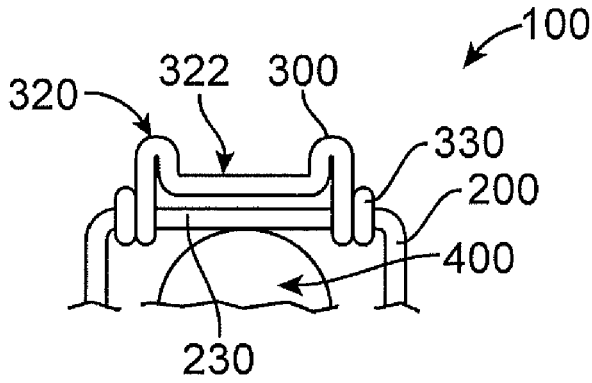
FIG. 4 is an end view of a clip for joining reinforcing members for use in reinforced concrete slabs and/or columns in accordance with an embodiment.

FIG. 4 is an end view of a clip 100 for joining reinforcing members 400, 500 for use in reinforced concrete slabs and/or columns in accordance with an embodiment. As shown in FIG. 4, the lower mid-portion 320 of the second wire member 300 rests on the upper surface 410 of the second reinforcing member 400 when the clip 100 is initially applied or attached to the first and second reinforcing members 400, 500. In accordance with an embodiment, the lower mid-portion 320 has a curved saddle 322, which is adapted to wrap around an upper surface 410 of the second reinforcing member 400 and more preferably the curved saddle portion 322 fits within the ridge (or groove) 600 of the second reinforcing member 400.

Figure 5:
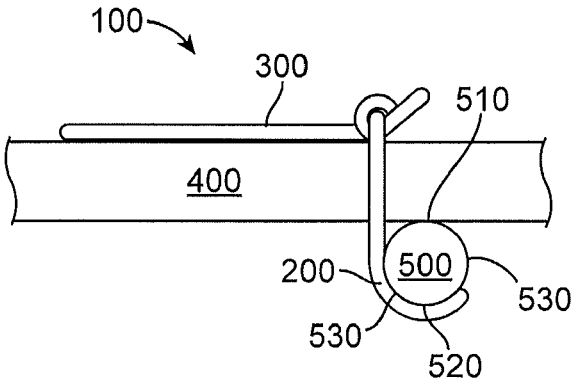
FIG. 5 is a side view of a clip for joining reinforcing members for use in reinforced concrete slabs and/or columns in accordance with another embodiment.
Figure 6:
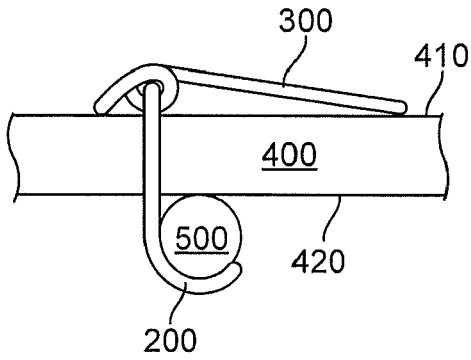
FIG. 6 is a side view of the clip for joining reinforcing members for use in reinforced concrete slabs and/or columns as shown in FIG. 5 in accordance with an embodiment.

FIGS. 5 and 6 are side views of a clip 100 showing a method of joining reinforcing members 400, 500 for use in reinforced concrete slabs and/or columns in accordance with an embodiment. As shown in FIGS. 5 and 6, the method of joining reinforcing members 400, 500 includes positioning a first reinforcing member 500 perpendicular to a second reinforcing member 400, and attaching the first reinforcing member 500 to the second reinforcing member 400 with a clip 100. The clip 100 includes a first wire member 200 having an upper mid-portion 230 and pair of parallel legs 220, each of the parallel legs 220 having a hook portion 210 adapted to wrap around a lower surface 520 of the first reinforcing member 500. A second wire member 300 having a lower mid-portion 320 is sized to rest on an upper surface 410 of the second reinforcing member 400, each end 330 of the lower mid-portion 320 extends outward and wraps around an outer portion of the upper mid-portion 230 of the first wire member 200 at least once and extending parallel to the second reinforcing member 400 to form a handle portion.

In accordance with an embodiment, the step of attaching the first reinforcing member 500 to the second reinforcing member 400 with a clip 100 further includes hooking the hook portion 210 around the lower surface 520 of the first reinforcing member 500. The handle portion 310 is then moved from a first position wherein the lower mid-portion 320 of the second wire member 300 is resting on an upper surface 410 of the second reinforcing member 400 to a second position wherein the mid-portion 320 of the second wire member 300 imposes a downward load (or pressure) on the second reinforcing member 400. The downward load (or pressure) on the second reinforcing member 400 translates into upward lift or force of the hook portions 210 around the lower surface 520 of the first reinforcing member 500.

Figure 7:
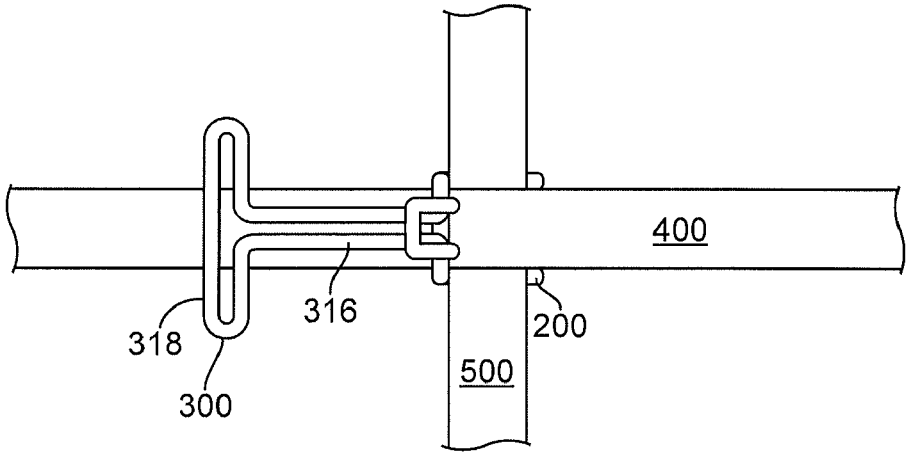
FIG. 7 is a top view of a clip for joining reinforcing members for use in reinforced concrete slabs and/or columns in accordance with another embodiment.

FIG. 7 is a top view of a clip 100 for joining reinforcing members 400, 500 for use in reinforced concrete slabs and columns in accordance with another embodiment. The clip 100 includes a first wire member 200 an upper mid-portion 230 and pair of parallel legs 220, each of the parallel legs 220 having a hook portion 210 adapted to wrap around a lower surface 520 of a first reinforcing member 500, and a second wire member 300 having a lower mid-portion 320 sized to seat on an upper surface 410 of a second reinforcing member 400, which resides perpendicular to the first reinforcing member 500. Each end 330 of the lower mid-portion 320 extends outward and wraps around an outer portion of the upper mid-portion 230 of the first wire member 200 at least once and extending parallel to the second reinforcing member 400 to form a handle portion 310 of the clip 100.

As shown in FIG. 7, in accordance with an embodiment, the handle portion 310 includes a narrow neck portion 316 and a wide handle portion 318. The wide handle portion 318 extends outward from the narrow neck portion 316. In accordance with a preferred embodiment, the wide handle portion 318 is sized to fit within the palm of the installer and/or user.

Figure 8:
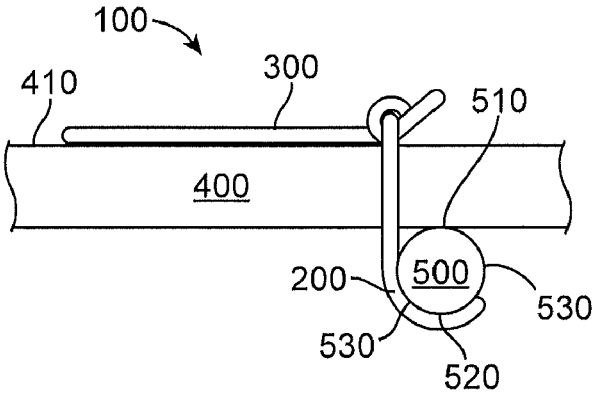
FIG. 8 is a side view of a clip for joining reinforcing members for use in reinforced concrete slabs and/or columns in accordance with a further embodiment.
Figure 9:
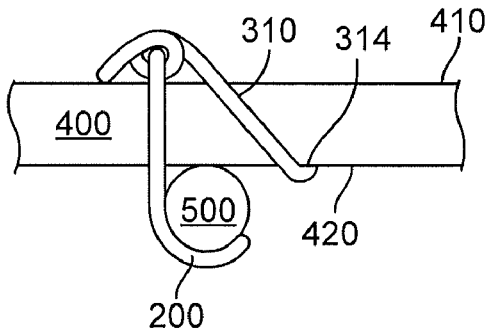
FIG. 9 is a side view of a clip for joining reinforcing members for use in reinforced concrete slabs and/or columns of FIG. 8 in accordance with an embodiment.

FIGS. 8 and 9 are side views of a clip 100 showing another method of joining reinforcing members 400, 500 for use in reinforced concrete slabs and/or columns. As shown in FIGS. 8 and 9, the method of joining reinforcing members 400, 500 includes positioning a first reinforcing member 500 perpendicular to a second reinforcing member 400, and attaching the first reinforcing member 500 to the second reinforcing member 400 with a clip 100. The clip 100 includes a first wire member 200 having an upper mid-portion 230 and pair of parallel legs 220, each of the parallel legs 220 having a hook portion 210 adapted to wrap around a lower surface 520 of the first reinforcing member 500. A second wire member 300 having a lower mid-portion 320 is sized to rest on an upper surface 410 of the second reinforcing member 400, each end 322 of the lower mid-portion 320 extends outward and wraps around an outer portion of the upper mid-portion 230 of the first wire member 200 at least once and extending parallel to the second reinforcing member 400 to form a handle portion 310. The handle portion 320 is preferably open, such that the ends 314 of the handle portion 310 are configured to hook and/or wrap around a lower surface 420 of the second reinforcing member 400.

Figure 10:
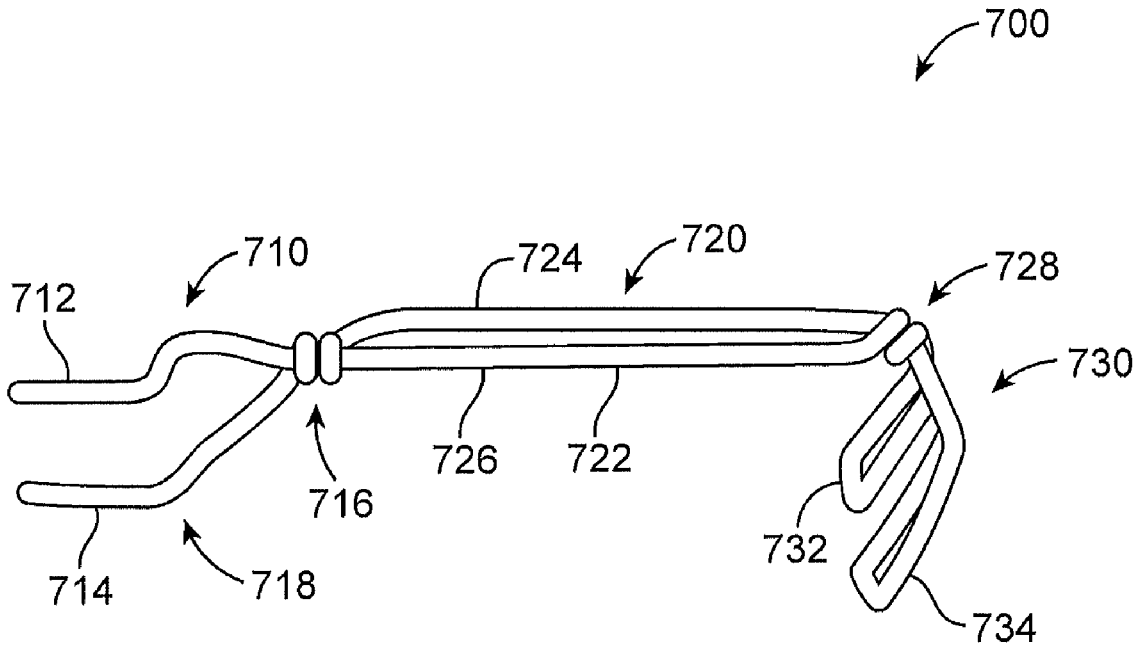
FIG. 10 is a perspective view of a clip for joining reinforcing members for use in reinforced concrete slabs and/or columns in accordance with one embodiment.

FIG. 10 is a perspective view of a clip 700 for joining reinforcing members 400, 500 for use in reinforced concrete slabs and/or columns in accordance with another exemplary embodiment. As shown in FIG. 10, the clip 700 has a first pair of legs (or first set of fork-like members) 710, a second pair of legs (or second set of fork-like members) 730, and a mid-portion 720, which extends between the first and second pairs of the legs 710, 730. Each of the legs 712, 714 of the first pair of legs 710 preferably has a portion 718 having a curvature therein, which is adapted to wrap around a lower surface of a first reinforcing member 400. An inner surface of each of the legs 732, 734 of the second pair of legs 730 is preferably adapted or configured to wrap around at least a portion of a side surface of a second reinforcing member 500. A mid-portion (or connection member) 720 connects the first pair of legs 710 to the second pair of legs 730.

As shown in FIG. 10, the first pair of legs 710 includes a pairs of legs 712, 714, each of which includes a slight bend and/or curvature thereto 718, which assists with the securing of an upper edge thereof to an underneath portion of the second reinforcing member 500. The pairs of legs 710 are preferably approximately 1.0 inches to 5.0 inches in length for securing reinforcing members 400, 500 having an outer diameter of approximately 0.5 inches to 1.5 inches, and more preferably approximately 1.0 to 2.5 inches in length to the mid-portion 720 of the clip 700. It can be appreciated that the length of the legs 712, 714 of the first pair of legs 710 is preferably a function of the size (i.e., diameter) of the reinforcing members 400, 500.

The second pair of legs 730 extends from the opposite end 728 of the mid-portion 720 downward and around each side or edge of the first reinforcing member 400. The second pair of legs 730 can be comprised of one or more wires, which extends downward to form a loop at lower end thereof as shown in FIG. 10. It can be appreciated that the loop at the other end (i.e., second end) 728 of the mid-portion 720 of the clip 700 as shown in FIG. 10 is optional, and the clip 700 can be manufactured with a single wire pair of legs 720 rather the looped pair of legs 730 as shown in FIG. 10. For example, in accordance with an exemplary embodiment, the second pair of legs 730 can be a pair of single wires or members (i.e., no looping of the wire), which can be a weld or affixed by any suitable means to the other end or second end 728 of the mid-portion of the clip 700. Each of the legs 732, 734 of the second pair of legs is preferably approximately 0.5 inches to 3.0 inches in length for securing reinforcing members 400, 500 having an outer diameter of approximately 0.5 inches to 1.5 inches, and more preferably approximately 1.0 to 2.5 inches in length to the mid-portion 720 of the clip 700. It can be appreciated that the length of the legs 732, 734 of the second pair of legs 730 is preferably a function of the size (i.e., diameter) of the reinforcing members 400, 500.

The mid portion 720 of the clip 700 extends between the first and second pair of legs 710, 730, and provides leverage to secure the clip 700 to the two reinforcing member 400, 500. The mid portion 720 is preferably between approximately 0.5 to 5 inches, and more preferably approximately 1.0 to 3.0 inches in length.

In accordance with an exemplary embodiment, the clip 700 can be manufactured from one or more wires or other members. As shown in FIG. 10, when constructed from a pair of wires, at each end 716, 728 (i.e., a first end and a second end, respectively) of the mid-portion 720, the wires are preferably wrapped around one another. In accordance with an exemplary embodiment as shown, the clip 700 can be manufactured without the need to weld the pair of wires to one another. Alternatively, the clip 700 can be manufactured or formed from one or more wires, which are welded to another. As such, rather than having the wires wrapped around one another as shown in FIG. 10, the mid-portion 720 can be a single wire or member, which is welded to a pair of legs (or fork-like members) 710 at one end 716 and a second pair of legs (or fork-like members) 730 at the other end 728.

Figure 11:
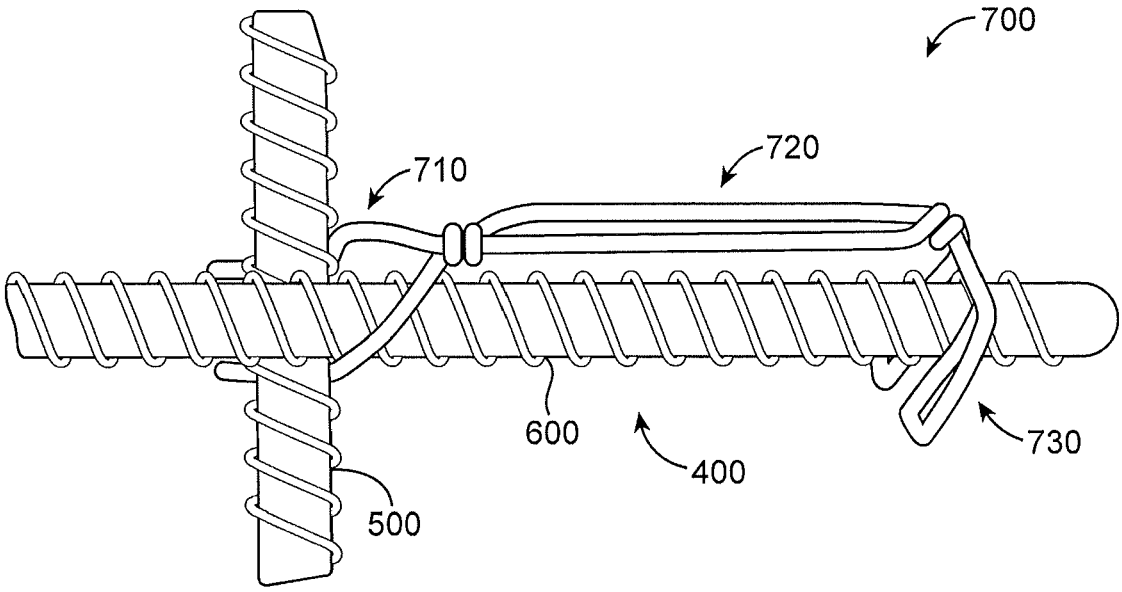
FIG. 11 is a perspective view of a clip for joining reinforcing members for use in reinforced concrete slabs and/or columns wherein the clip is securing a pair of reinforcing members to one another.

FIG. 11 is perspective view of a clip for joining reinforcing members 400, 500 for use in reinforced concrete slabs and/or columns wherein the clip 700 is securing a pair of reinforcing members 500, 600 to one another. As shown in FIG. 11, the first pair of legs 710 is configured to portion adapted to wrap underneath and/or around a lower surface of a second reinforcing member 500. The second pair of legs 730 is configured to wrap around each of the respective sides of the first reinforcing member 400. The mid-portion 720 extends from the first pair of legs 710 to the second pair of legs 730 and creates tension on the second reinforcing member 500 and the second reinforcing member 400 such that during use, the two reinforcing members 400, 500 are pressed tightly together and cannot move in any directions including vertically and/or horizontally.

In accordance with an exemplary embodiment as shown in FIG. 11, the first pair of legs 710 extends from an upper portion of the first reinforcing member 400 and underneath a lower portion or surface of the second reinforcing member 500. If, the first pairs of legs 710 has a curvature thereto, which exceed the diameter (or width) of the first and second reinforcing members 400, 500, the ends of the first pair of legs 710 will extend partially around a lower side or portion of the first reinforcing member 400. The mid-portion 720 rests on or slightly above, an upper surface of the first reinforcing member 400. The second pair of legs 730 extends from the opposite end 728 of the mid-portion 720 downward and around each side or edge of the first reinforcing member 400. Although the ends of the second pair of legs 730 are shown as extending towards the first pair of legs 710, it can be appreciated that the second pair of legs 730 can extend slightly towards the first pair of legs 710, approximately perpendicular to the side or edge of the first reinforcing member 400 upon which it sits, and/or slightly away from the first pair of legs 710.

In accordance with an exemplary embodiment, the clip 700 is preferably made of a stiff resiliently yielding material, such as spring steel. However, it can be appreciated that the clip 700 can be made from a high-carbon spring steel, an alloy spring steel, a stainless spring steel, a copper-base spring alloy, a nickel-base spring alloy and/or any combination thereof.

The first and second reinforcing members 400, 500 can be a wire mesh, steel reinforcing rods or members (i.e., steel rebar) or any other suitable material, which is used for reinforced concrete and reinforced masonry structures, including concrete slabs and/or columns. In accordance with an embodiment, the first and second reinforcing members 400, 500 are steel reinforcing members (i.e., rebar) formed from carbon steel with a plurality ridges (or grooves) 600, which extend around the outer circumference of the reinforcing members 400, 500, and also extending longitudinally or lengthwise. In accordance with an embodiment, the ridges (or grooves) 600 can be a plurality of circular rings or other suitable circular pattern or shape. Alternatively, it can be appreciated that other non-circular patterns can be used. It can be appreciated that in reinforced concrete slabs and/or columns, the ridges (or grooves) 600 provide frictional adhesion for the concrete. In addition, the first and second reinforcing members 400, 500 preferably have a coefficient of expansion, which is approximately equal to that of the concrete to provide for a stable slab and/or column.

Figure 12:
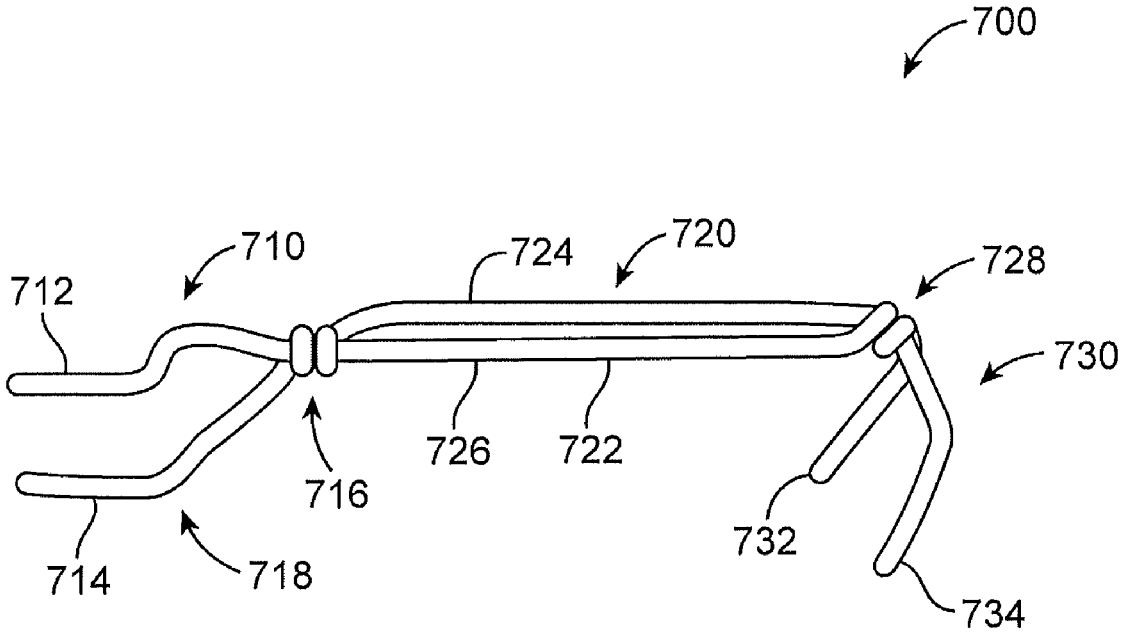
FIG. 12 is a perspective view of a clip for joining reinforcing members for use in reinforced concrete slabs and/or columns in accordance with another embodiment.

FIG. 12 is a perspective view of a clip 700 for joining reinforcing members for use in reinforced concrete slabs and/or columns in accordance with another embodiment. As shown in FIG. 12, the clip 700 can be manufactured or formed from one or more wires, which are twisted together and/or alternatively, welded to one another. In accordance with an exemplary embodiment, the mid-portion 720 can be a single or pair of wires or members, which is welded to a pair of legs (or fork-like members) 710 at one end 716 and a second pair of legs (or fork-like members) 730 at the other end 728. As shown in FIG. 12, each of the second pair of legs 730 can be a single leg (or member), which extends downward from the second end 728 of the mid portion 720 of the clip 700. In accordance with an exemplary embodiment, if the clip is formed by welding one or more wires to one another, each of the legs of the first and second pair of legs 710, 730 is preferably a single wire and/or member, and the mid-portion 720 is a single wire and/or member, rather than a pair of wires as shown in FIGS. 10-12.

It will be understood that the foregoing description is of the preferred embodiments, and is, therefore, merely representative of the system and methods of use of the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A system for joining reinforcing members comprising:

a first reinforcing member;

a second reinforcing member, which resides perpendicular to the first reinforcing member; and a clip comprising:

a first pair of legs, each of the legs of the first pair of legs having a portion having a curvature thereto and adapted to wrap around a lower surface of a first reinforcing member;

a second pair of legs, each of the legs of the second pair of legs having an inner surface adapted to exert a force against at least a portion of a side surface of a second reinforcing member forming a set of fork-like members, which do not extend around a lower surface of the second reinforcing member, and a mid-portion, which connects the first pair of legs to the second pair of wherein the clip is formed from one or more pieces of wire, and wherein a first and second end of the midportion is formed by wrapping the wire around itself.

2. The system of claim 1, wherein each of the second pair of legs includes an inner portion and an outer portion thereto, and the inner portion of the second pair of legs is adapted to wrap around the side surface of the second reinforcing member.

3. The system of claim 1, wherein the first and second reinforcing members are steel reinforcing members.

4. The system of claim 1, wherein a downward load imposed on the second pair of legs translates into an upward lift of the first pair of legs around the lower surface of the second reinforcing member.

5. A method of joining reinforcing members comprising:

positioning a first reinforcing member perpendicular to a second reinforcing member; and attaching the first reinforcing member to the second reinforcing member with a clip, the clip comprising:

a first pair of legs, each of the legs of the first pair of legs having a portion having a curvature thereto and adapted to wrap around a lower surface of a first reinforcing member;

a second pair of legs, each of the legs of the second pair of legs having an inner surface adapted to exert a force against at least a portion of a side surface of a second reinforcing member forming a set of fork-like members, which do not extend around a lower surface of the second reinforcing member, and a mid-portion, which connects the first pair of legs to the second pair of wherein the clip is formed from one or more pieces of wire, and wherein a first and second end of the midportion is formed by wrapping the wire around itself.

6. The method of claim 5, wherein the step of attaching the first reinforcing member to the second reinforcing member with a clip further comprises hooking the first pair of legs around the lower surface of the first reinforcing member, and pushing the second set of legs downward around the second reinforcing member.

* * * * *